US006341885B1

(12) United States Patent
Futami et al.

(10) Patent No.: US 6,341,885 B1
(45) Date of Patent: Jan. 29, 2002

(54) VEHICLE LAMP

(75) Inventors: Takashi Futami; Teruo Koike; Hirotada Kobayashi, all of Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/659,562

(22) Filed: Sep. 11, 2000

(30) Foreign Application Priority Data

Sep. 14, 1999 (JP) ..... 11-260386

(51) Int. Cl.[7] ..... F21V 7/00
(52) U.S. Cl. ..... 362/518; 362/297; 362/348
(58) Field of Search ..... 362/518, 296, 362/297, 348

(56) References Cited

U.S. PATENT DOCUMENTS 6,007,223 A * 12/1999 Futami ..... 362/517
6,045,245 A * 4/2000 Kanou ..... 362/518
6,129,447 A * 10/2000 Futami ..... 362/522

FOREIGN PATENT DOCUMENTS

| | | |
|---|---|---|
| JP | 7-326203 | 12/1995 |
| JP | 9-82121 | 3/1997 |
| JP | 9167504 | 6/1997 |
| JP | 9-231813 | 9/1997 |

* cited by examiner

*Primary Examiner*—Sandra O'Shea
*Assistant Examiner*—Ronald E. DelGizzi
(74) *Attorney, Agent, or Firm*—Morgan, Lewis & Bockius LLP

(57) ABSTRACT

A vehicle lamp is disclosed which includes a reflector 3 that is divided into two or more areas by predetermined lines as viewed from the front of the vehicle lamp. The two or more areas are separated by a difference of over 5 millimeter. In addition, the reflector can include a plurality of parabolic pillar shaped surfaces that gather at a central portion and can include a free-curved surface. The vehicle lamp provides an innovative appearance that can be varied to provide a plurality of possible aesthetic designs.

17 Claims, 3 Drawing Sheets

VEHICLE LAMP

This invention claims the benefit of Japanese patent application No. HEI 11-260386, filed on Sep. 14, 1999, which is hereby incorporated by reference.

BACKGROUND OF THE INVENTION

1. Field of the Invention

This invention relates to a vehicle lamp used as a headlamp, a fog lamp or the like for lighting. More particularly, the invention relates to a vehicle lamp which includes a reflector that is able to form a particular light distribution pattern and an outer lens that has a higher ratio of transparency than that of a conventional vehicle lamp.

2. Discussion of the Related Art

FIG. 5 illustrates a conventional vehicle lamp 90 that includes a light source 91 such as a halogen lamp or a meta-halide discharge lamp or the like, a reflector 92, and an outer lens 93. The light source 91, the reflector 92 and the outer lens 93 from a light distribution pattern for the vehicle lamp 90. A hood 94 as shown in FIG. 5 is mounted to shield the direct light emitted from the light source 91. An extension 95 is formed to cover an aperture existing between the reflector 92 and the outer lens 93.

The reflector 92 includes a plurality of segments 92a formed by dividing the reflector with lines that are approximately parallel to a vertical line passing through the light source 91. The reflector 92 is formed as a parabolic pillar. A vertical cross sectional view of each segment 92*a* is a parabola line having a focus close to the light source 91, and a horizontal cross sectional view of the each segment 92*a* is a straight line. The light distribution pattern of the vehicle lamp 90 is characterized in that the illuminating angle in the horizontal direction of the reflector 92 is wide, while the illuminating angle in the vertical direction of the reflector 92 is narrow.

Lens cuts for diffusing light from the light source are not formed on the outer lens 93 so that the inner portions of the vehicle lamp can be seen through the outer lens 93. Thus, the horizontal width of the vehicle lamp 90 appears to be large. Since the form of the reflector 92 can be seen through the outer lens 93, the transparency and the brightness of the vehicle lamp can be improved.

Since the reflector 92 is formed by connecting a plurality of segments 92*a*, the reflector 92 has a longitudinal line at each connecting portion of the segments 92*a*. the longitudinal lines can be eliminated by controlling/manipulating the horizontal cross sectional configuration of the parabolic pillar surface. This kind of a reflector is usually referred to as a parabolic free-curved surface.

Since the predetermined standard form of light distribution pattern is formed only by the reflector 92 in the conventional vehicle lamp 90, it is difficult to realize many kinds of forms or characteristics for the reflector 92. In addition, since the outer lens 93 is transparent, it is difficult to change the design of the lens 93 for different applications. As a result, the designs of vehicle lamps have become similar to each other.

The invention is intended to substantially obviate at least the above problems. The invention makes it possible to provide a vehicle lamp which has unique design characteristics. In addition, the invention is effective in improving and developing the aesthetic design of the vehicle lamp.

SUMMARY OF THE INVENTION

Additional features and advantages of the invention will be set forth in the description that follows, and in part, will be apparent from the description, or may be learned by practice of the invention. The objectives and other advantages of the invention will be realized and achieved by the structure particularly pointed out in the written description and claims hereof as well as by the appended drawings.

The invention is directed to a vehicle lamp and the like that substantially obviates one or more of the problems due to the limitations and disadvantages of conventional vehicle lamps.

According to the invention, the above objects can be achieved by providing a vehicle headlamp which includes a reflector formed by gathering a plurality of parabolic pillar-shaped surfaces at a free-curved surface formed by smoothing the connecting divisional lines between each parabolic pillar surface. The light can include a transparent outer lens. The reflector of the vehicle lamp looks as if it is divided into two or more areas by predetermined lines when the vehicle lamp is seen from the front. There can be a difference in level of over 5 millimeters between each area of the reflector.

Another object of the invention is to provide a vehicle lamp 1 with an innovative design that is different from that of the conventional vehicle lamp.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the claimed invention.

DETAILED DESCRIPTION OF THE PREFERRED EMBODIMENTS

Figure 1:
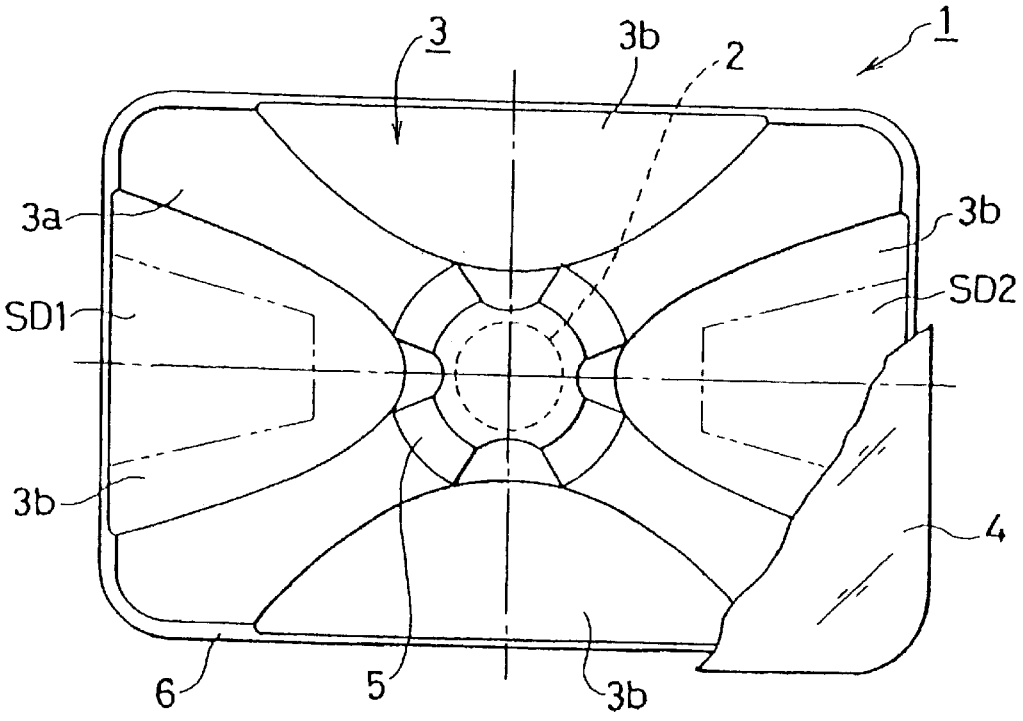
FIG. 1 is a partial front view of an embodiment of a vehicle lamp made on accordance with the principles of the invention.
Figure 2:
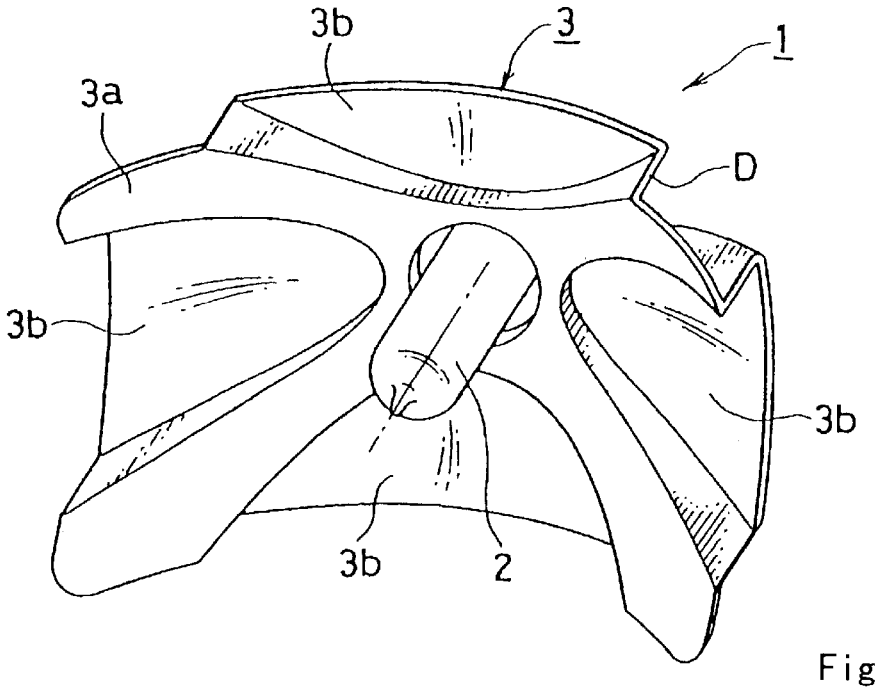
FIG. 2 is a partial perspective view of the embodiment shown in FIG. 1.

Preferred embodiments of the invention will be described with reference to the drawings. As shown in FIGS. 1 and 2, the vehicle lamp 1 can include a bulb 2 which acts as a light source, a reflector 3 which can be formed by gathering a plurality of parabolic pillar-shaped surfaces at a parabolic free-curved surface located at a central portion of the reflector, and an outer lens 4. The characteristics of the light distribution pattern are formed by the reflector 3. Accordingly, the outer lens 4 can be appropriately designed to have a curved surface in order to conform with the design of a vehicle. In addition, the outer lens of the invention does not have a substantial effect on forming the characteristics of the light distribution pattern. Further, since the outer lens can be transparent and does not include light diffusing cuts, the inner portions of the vehicle lamp can be seen through the outer lens. The reflector 3 can have a longitudinal axis that extends outward from the reflector and approximately parallel to the direction of light that is reflected by the reflector 3.

The reflector 3 can be freely divided into two or more areas by appropriately predetermined divisional lines. FIGS. 1 and 2 show the reflector 3 divided into two parts 3*a* and 3*b*. As mentioned above, the design of dividing the reflector into areas can basically be freely determined. However, when a low beam light distribution pattern is required, low-beam areas SD1 and SD2 in FIG. 1, can be areas formed between ±15 degrees to the horizontal center line of the reflector 3 and which have a width of over 50 millimeters. These low-beam areas are preferably not divided into different or separate areas. The areas SD1 and SD2, referred to as elbows, are used for forming a low beam light distribution pattern and for providing and appropriate amount of upwardly directed light on only a side of the vehicle closest to the shoulder of a road. In order to provide vehicles for both left and right side passages, two areas SD1 and SD2 can be formed on the reflector of the vehicle lamp 1.

The areas 3*a* and 3*b* can be formed as partial reflection surfaces or parabolic free-curved surfaces by gathering a plurality of parabolic pillar shaped surfaces. Specifically, area 3*a* can include a plurality of parabolic pillar shaped surfaces that are gathered together at a central portion, and area 3*b* can include a parabolic free curved surface. If the focus distance of the area 3*a* is shorter than that of the area 3*b*, a difference in level, separated by separation surface D is formed between areas 3*a* and 3*b*. The height of the difference in level shown by separation surface D is preferably approximately 5 millimeters or more. When the difference in level is less than 5 millimeters, it is difficult to clearly see areas 3*a* and 3*b*, and thus the appropriate function or effect of areas 3*a* and 3*b* can not be realized.

The characteristic of the light distribution pattern of the vehicle lamp 1 is formed by the areas 3*a* and 3*b*. Area 3*a* can include a reflection surface formed by gathering a plurality of parabolic pillar shaped surfaces, and area 3*b* can be formed with parabolic free-curved surfaces.

Figure 3:
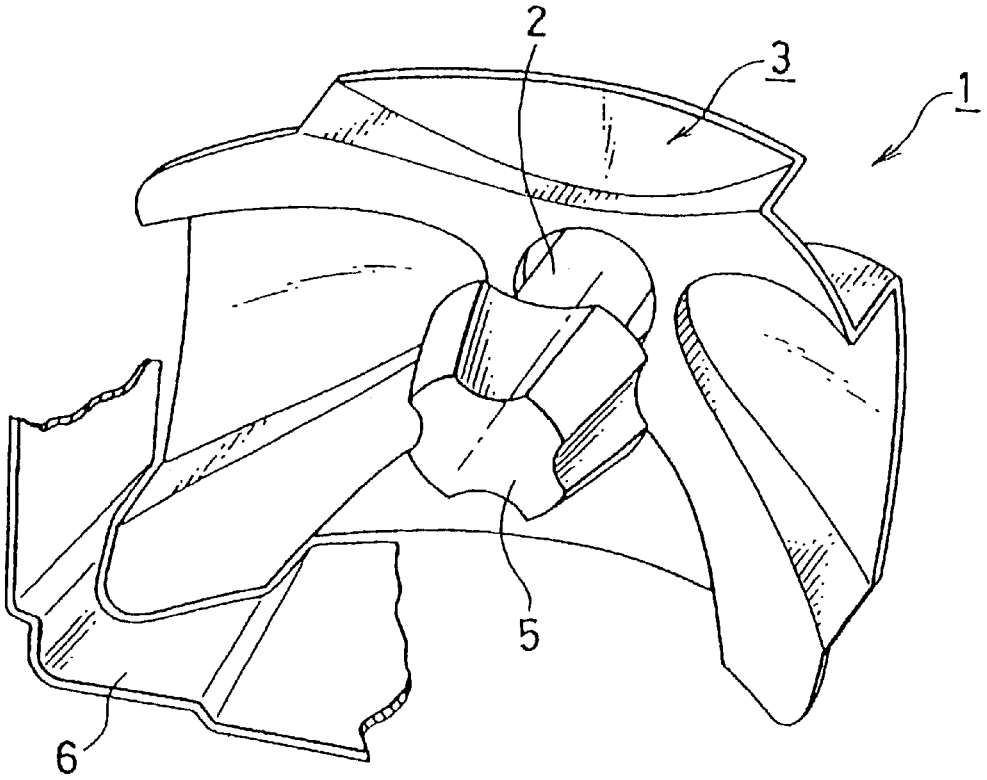
FIG. 3 is a partial cross-sectional and perspective view of another embodiment of the invention.

FIG. 3 shows another embodiment of the vehicle lamp 1 of the invention. When the vehicle lamp 1 is in a low beam light distribution pattern, the lamp makes use of a hood 5 and an extension 6. The hood 5 is used to shield direct light from a bulb 2, and the extension 6 is used to cover the aperture between the reflector 3 and an outer lens 4. The hood 5 and the extension 6 can be utilized to improve the quality of the vehicle lamp.

The hood 5 and the extension 6 can also be designed such that the reflector 3 can be configured in many different shapes and styles.

Figure 4:
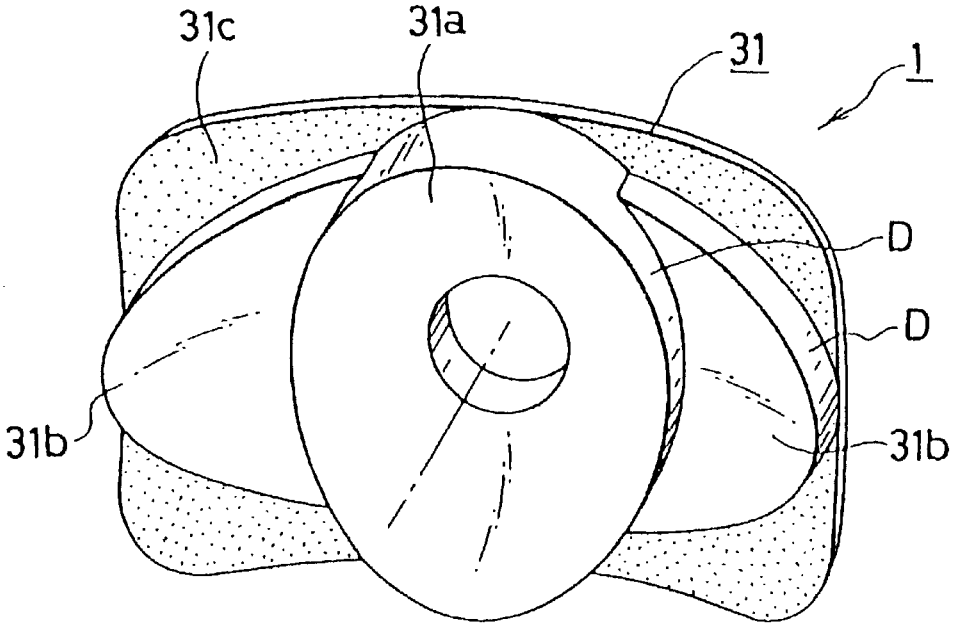
FIG. 4 is a perspective view of another embodiment of the invention.
Figure 5:
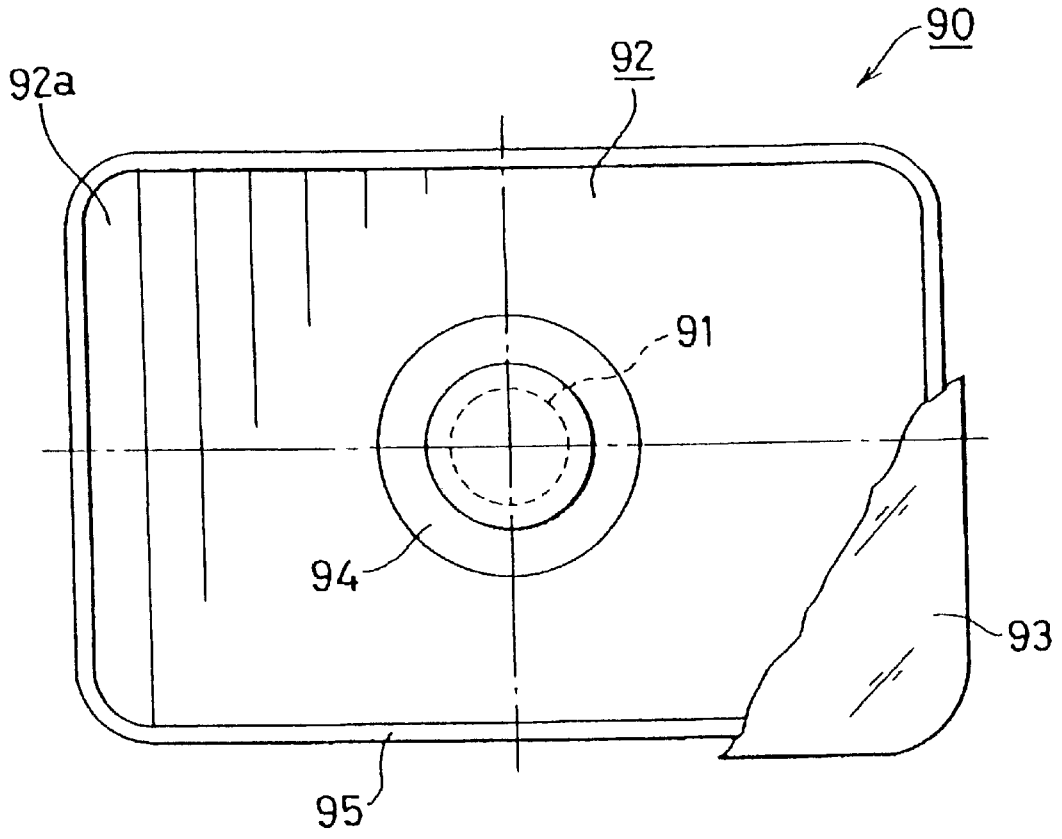
CONVENTIONAL ART Fig. 5
FIG. 5 is a partial front view of a conventional vehicle lamp.

FIG. 4 shows another embodiment of the vehicle lamp of the invention. A reflector 31 is divided into areas 31*a*, 31*b* and 31*c* in this embodiment. There is a difference in level, separated by separation surface D, formed between the areas 31*a*, 31*b* and 31*c* of the reflector.

Although each of the areas 31*a* through 31*c* can be formed as a partial reflection surface, area 31*c* is located at a place where light from the bulb 2 can not reach. Thus, area 31*c* can be painted or include non-reflecting color material in order to prevent the area 31*c* from emitting light. The difference between the designs of areas 31*a* and 31*b* can be made prominent so as to provide an innovative design for the vehicle lamp. Further, the separation surfaces D that creates the difference in levels between the areas 31*a* and 31*b* can be painted or include non-reflecting material in order to prevent emission of light and provide a unique aesthetic appearance.

The invention provides a vehicle lamp that has an innovative design and has many original characteristics. The vehicle lamp can include a reflector which has two or more areas divided by predetermined divisional lines and a difference in level between the areas of over 5 millimeters. The vehicle lamp improves the entire design of the vehicle in an aesthetic aspect. In addition, since the design of the reflector is formed by predetermined divisional lines, many different kinds of designs for vehicle lamps can be realized.

It will be apparent to those skilled in the art that various modifications and variations can be made to the disclosed embodiments of the vehicle lamp without departing from the spirit or scope of the invention. It is intended that the invention cover the modifications and variations of this invention provided they come within the scope and spirit of the appended claims and their equivalents.

What is claimed is:

1. A vehicle lamp, comprising:

a light source;

an outer lens located in front of said light source; and a reflector including a plurality of parabolic pillar-shaped surfaces gathered together and a parabolic free-curved surface, said reflector having a longitudinal axis and being divided into at least two areas as viewed from a front of said vehicle lamp, said at least two areas being separated along said longitudinal axis by a difference of approximately at least 5 millimeters.

2. The vehicle lamp of claim 1, wherein an undivided low-beam area is contained within one of said at least two areas, said low beam area located between ±15 degrees from a horizontal line through a center of said reflector, and said low beam area having a width of less than approximately 50 millimeters.

3. The vehicle lamp of claim 1, further comprising:

a space located between said lens and said reflector; and an extension located adjacent said space between said lens and said reflector.

4. The vehicle lamp of claim 1, further comprising:

a hood located adjacent said light source, said hood having surfaces that correspond in shape to portions of a perimeter of one of said at least two areas.

5. The vehicle lamp of claim 1, wherein said lens is transparent.

6. A vehicle lamp, comprising:

a light source;

a lens located in front of said light source;

a hood located adjacent said light source; and a reflector including parabolic pillar shaped surfaces that are gathered together and a parabolic free-curved surface, said reflector having a longitudinal axis and being divided into different areas as viewed along said longitudinal axis from a front of said vehicle lamp, said different areas being separated by a difference in level along said longitudinal axis of over approximately 5 millimeters; and an extension located between said reflector and said lens.

7. The vehicle lamp of claim 6, further comprising:

a separation surface separating said different areas, wherein at least one of said separation surface, said extension, and said hood includes a portion having a colored material.

8. The vehicle lamp of claim 6, wherein said lens is an outer transparent lens.

9. A vehicle lamp, comprising:

a light source;

a lens located in front of said light source; and a reflector having a longitudinal axis, and including a parabolic surface, a parabolic free-curved surface, and at least two areas as viewed from a front of said vehicle lamp, said areas being separated along said longitudinal axis by a difference of approximately at least 5 millimeters.

10. The vehicle lamp of claim 9, further comprising:

a separating area located between said at least two areas and distinct from said parabolic surface and said parabolic free-curved surface.

11. The vehicle lamp of claim 9, wherein a low-beam area is contained within one of said at least two areas and is located between ±15 degrees from a horizontal line through a center of said reflector, said low-beam area having a width of less than approximately 50 millimeters.

12. The vehicle lamp of claim 9, further comprising:

a space located between said lens and said reflector; and an extension located adjacent said space between said lens and said reflector.

13. The vehicle lamp of claim 9, further comprising:

a hood located adjacent said light source, said hood having surfaces that correspond in shape to portions of a perimeter of one of said at least two areas.

14. The vehicle lamp of claim 9, wherein said lens is transparent.

15. The vehicle lamp of claim 9, wherein said reflector includes a plurality of parabolic surfaces, said parabolic surfaces being pillar shaped and gathered at a central portion.

16. The vehicle lamp of claim 15, wherein said plurality of parabolic pillar shaped surfaces form a continuous surface which forms one of said at least two areas.

17. The vehicle lamp of claim 16, wherein said continuous surface is offset from the other of said at least two areas.

* * * * *